US009339111B1

(12) United States Patent
Lynn

(10) Patent No.: US 9,339,111 B1
(45) Date of Patent: May 17, 2016

(54) CABINET GUARD AND ASSOCIATED USE THEREOF

(71) Applicant: Donald Lynn, Palm Beach Gardens, FL (US)

(72) Inventor: Donald Lynn, Palm Beach Gardens, FL (US)

( * ) Notice: Subject to any disclaimer, the term of this patent is extended or adjusted under 35 U.S.C. 154(b) by 248 days.

(21) Appl. No.: 13/852,991

(22) Filed: Mar. 28, 2013

(51) Int. Cl.
*A47B 97/00* (2006.01)
*A47B 95/04* (2006.01)
*B65D 81/05* (2006.01)

(52) U.S. Cl.
CPC ..... *A47B 97/00* (2013.01); *A47B 95/043* (2013.01); *A47B 2095/046* (2013.01); *B65D 81/053* (2013.01); *B65D 81/054* (2013.01); *B65D 81/055* (2013.01); *B65D 81/056* (2013.01); *Y10T 428/2457* (2015.01); *Y10T 428/24628* (2015.01)

(58) Field of Classification Search
CPC ..... A47B 97/00; A47B 95/043; A47B 2095/046; Y10T 428/2457; Y10T 428/24628; B65D 81/053; B65D 81/054; B65D 81/055; B65D 81/056
See application file for complete search history.

(56) References Cited

U.S. PATENT DOCUMENTS

| | | | | | |
|---|---|---|---|---|---|
| 2,115,130 | A * | 4/1938 | Shults | A47B 13/12 108/27 |
| 3,049,260 | A | 8/1962 | Stone | |
| 3,294,353 | A * | 12/1966 | Rowe | 248/346.01 |
| 3,762,626 | A | 10/1973 | Dorsey | |
| D271,070 | S | 10/1983 | Durkee | |
| 5,424,108 | A * | 6/1995 | Whetstone | 428/99 |
| 7,743,538 | B2 | 6/2010 | Parenti | |
| 2008/0196315 | A1 * | 8/2008 | Brisbois et al. | 49/462 |

OTHER PUBLICATIONS

Bifurcate—Merriam-Webster Dictionary, http://www.merriam-webster.com/dictionary/bifurcate, Feb. 27, 2015.*

* cited by examiner

*Primary Examiner* — Aaron Austin
*Assistant Examiner* — Jasper Saberi

(57) ABSTRACT

A cabinet guard includes a body generally shaped to having an L-like or C-like cross-section. Such a cross-section is configured by a plurality of sides including a long side, an intermediate side and a short side. Each side may extend along an entire longitudinal length of the body or may be adjusted to terminate prior to reaching an end of the body. The body may be snapped over edges of the cabinet/shelf framework, thereby protecting same from dents and dings while moving items (e.g., glasses, pots, pans, dishes, etc.) in and out of the cabinets/shelves.

15 Claims, 4 Drawing Sheets

CABINET GUARD AND ASSOCIATED USE THEREOF

CROSS REFERENCE TO RELATED APPLICATIONS

This application claims the benefit of U.S. Provisional Application No. 61/616,576 filed Mar. 28, 2012, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to cabinet accessories and, more particularly, to a cabinet guard for protecting an edge of cabinet/shelf framework from damage due to objects being put in or taken out of the cabinet/shelf.

2. Prior Art

Cabinets, furniture and the like are often provided with protruding edges that extend inwardly from an inner wall or a shelf for preventing premature displacement of items stored within the cabinet. While steps are taken to protect the items during placement and removal thereof, including packing the items in newspaper or the like, damage can occur to the cabinet edges.

For example, during item placement within the cabinet, the item may scrap or bump against the cabinet's protruding edges. Even after items have been placed within the cabinet, damage can occur as items are removed. One of the more vulnerable areas of a cabinet is the inner protruding edge of the cabinet. The inner protruding edge along the top, bottom and side edges forms a point that can be easily damaged as items are displaced from the cabinet. Even minor sliding of items within the cabinet can cause damage.

Similar problems are experienced with stand-alone furniture, such as shelving units, bedroom furniture including bureaus, dressers and the like. Such pieces support various items thereon, which are often moved during use/cleaning procedures. Such repeated handling increases the opportunity for damage to occur.

Installing and removing edge protectors is time-consuming. Self-fastening protectors in the form of a simple right-angle channel are known, but do not stay in position well and cannot be used if the thickness of cabinet's inner protruding edge is not uniform.

Accordingly, a need remains for cabinet guard in order to overcome prior art shortcomings. The exemplary embodiment(s) satisfy such a need by providing a cabinet guard that is convenient and easy to use, lightweight yet durable in design, versatile in its applications, and designed for protecting an edge of cabinet/shelf framework from damage due to objects being put in or taken out of the cabinet/shelf.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a cabinet guard for protecting an edge of a framework associated with a cabinet or shelf. These and other objects, features, and advantages of the non-limiting exemplary embodiment(s) are provided by a cabinet guard including a body having a plurality of sides suitably sized and shaped to be capable of fitting over the edge of the framework. Such sides preferably include a long side and an intermediate side attached thereto. The intermediate side extends at a generally ninety degree angle from the long side and each of the long side and the intermediate side is planar. In this manner, body has a substantially L-shaped cross-section.

In a non-limiting exemplary embodiment, the intermediate side includes a first groove scored along a longitudinal length thereof. Such a first groove travels in a linear direction defined substantially parallel to a longitudinal length of the long side wherein the first groove bifurcates a width of the intermediate side.

In a non-limiting exemplary embodiment, the plurality of sides further includes a short side conjoined to the intermediate side and oppositely seated from the long side, respectively. In this manner, the body has a substantially C-shaped cross-section.

In a non-limiting exemplary embodiment, the short side extends away from the intermediate side and is obliquely angled thereto such that the short side converges towards the long side. Notably, an oblique angle is defined between the short side and the intermediate side is may be approximately 15 degrees.

In a non-limiting exemplary embodiment, the short side is oriented at a non-perpendicular angle relative to the intermediate side such that a height of the short side is not parallel to a height of the long side.

In a non-limiting exemplary embodiment, a proximal edge of short side is spaced at a greater distance from the long side than a distance between a distal edge of the short side and the long side.

In a non-limiting exemplary embodiment, the short side includes a second groove scored along a longitudinal length thereof and spaced between the proximal edge and the distal edge. Such a second groove travels in a linear direction defined substantially parallel to the longitudinal length of the long side wherein the second groove bifurcates a height of the short side.

In a non-limiting exemplary embodiment, a plurality of third grooves are scored along the body and travel along a combined width of the long side, the intermediate side and the short side, respectively. Such third grooves are registered substantially orthogonal to the longitudinal length of the body.

In a non-limiting exemplary embodiment, the body includes a plurality of segments contiguously aligned at an end-to-end pattern along the longitudinal length of the body. Each of the segments has a uniform cross-section and extends along the long side, the intermediate side and the short side. In this manner, the third grooves are located at conjoined ends of the segments of the body. Notably, each of the long side, the intermediate side and the short side extends along the entire longitudinal length of the body.

The present disclosure also includes a method of utilizing a cabinet guard for protecting an edge of a framework associated with a cabinet or shelf. The method includes the chronological steps of: providing a body having a plurality of sides including a long side and an intermediate side attached thereto wherein the intermediate side extends at a generally ninety degree angle from the long side and wherein each of the long side and the intermediate side is planar; and fitting the sides over the edge of the framework.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
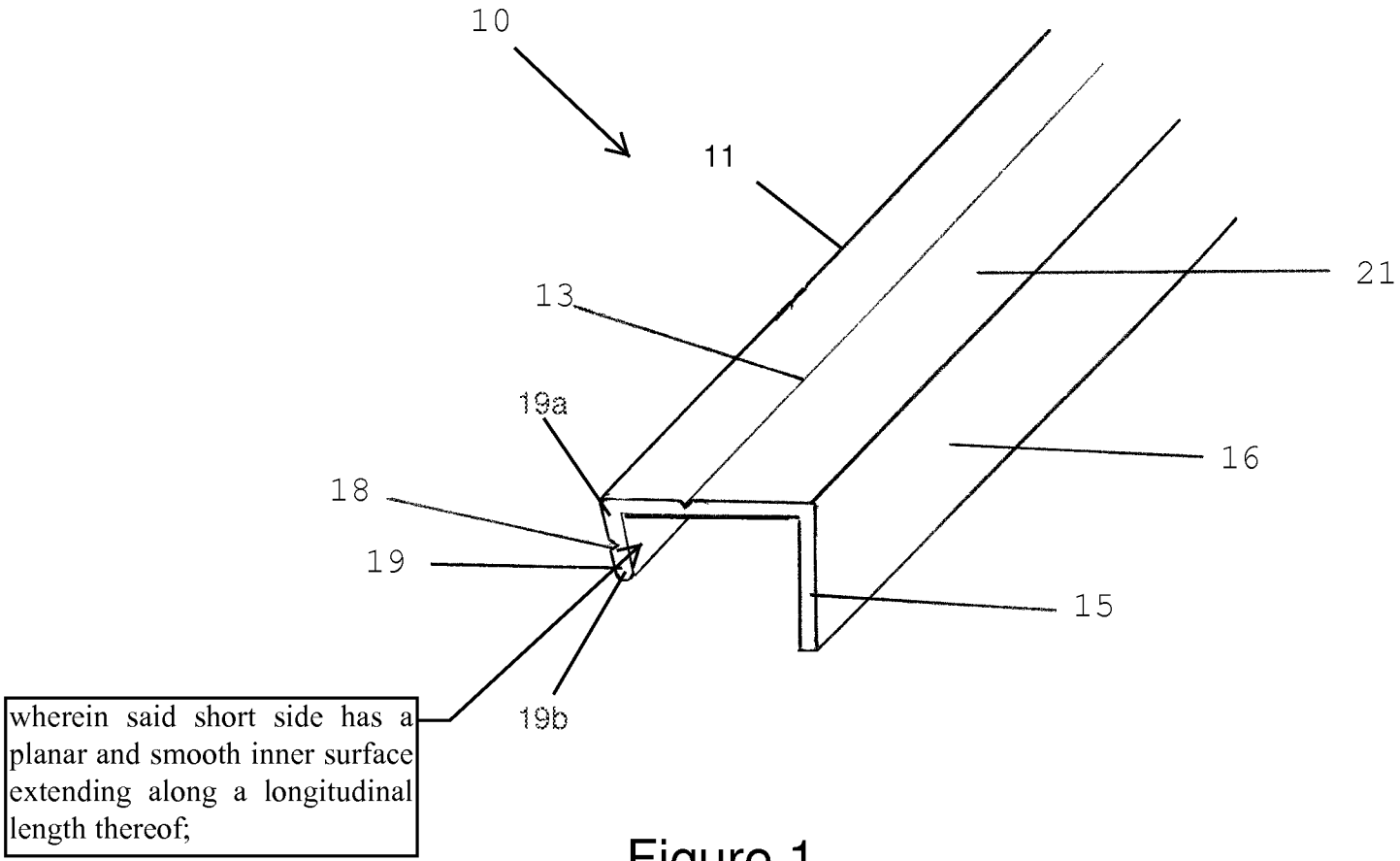
FIG. 1 is a perspective view of a cabinet guard for protecting an edge of cabinet/shelf framework, in accordance with the non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Non-limiting exemplary embodiments of the present disclosure are referred to generally in FIGS. 1-5 and are intended to provide a cabinet guard 10 for protecting an edge of cabinet/shelf framework from damage due to objects being put in or taken out of the cabinet/shelf. It should be understood that the exemplary embodiments may be used to protect edges of many different types of cabinets/shelves, and should not be limited to any particular cabinet/shelf design described herein.

The cabinet guard 10 includes a body 11 having a plurality of sides suitably sized and shaped to be capable of fitting over the edge of the framework. Such sides preferably include a long side 16 and an intermediate side 21 attached thereto. The intermediate side 21 extends at a generally ninety degree angle from the long side 16 and each of the long side 16 and the intermediate side 21 is planar. In this manner, body 11 has a substantially L-shaped cross-section.

In a non-limiting exemplary embodiment, the intermediate side 21 includes a first groove 13 scored along a longitudinal length thereof. Such a first groove 13 travels in a linear direction defined substantially parallel to a longitudinal length of the long side 16 wherein the first groove 13 bifurcates a width of the intermediate side 21.

In a non-limiting exemplary embodiment, the plurality of sides further includes a short side 19 conjoined to the intermediate side 21 and oppositely seated from the long side 16, respectively. In this manner, the body 11 has a substantially C-shaped cross-section.

In a non-limiting exemplary embodiment, the short side 19 extends away from the intermediate side 21 and is obliquely angled thereto such that the short side 19 converges towards the long side 16. Notably, an oblique angle is defined between the short side 19 and the intermediate side 21 and may be approximately 15 degrees.

In a non-limiting exemplary embodiment, the short side 19 is oriented at a non-perpendicular angle relative to the intermediate side 21 such that a height of the short side 19 is not parallel to a height of the long side 16. The height is defined between proximal edge 19*a* and distal edge 19*b*.

In a non-limiting exemplary embodiment, the proximal edge 19*a* of short side 19 is spaced at a greater distance from the long side 16 than a distance between the distal edge 19*b* of the short side 19 and the long side 16.

In a non-limiting exemplary embodiment, the short side 19 includes a second groove 18 scored along a longitudinal length thereof and spaced between the proximal edge 19*a* and the distal edge 19*b*. Such a second groove 18 travels in a linear direction defined substantially parallel to the longitudinal length of the long side 16 wherein the second groove 18 bifurcates a height of the short side 19.

In a non-limiting exemplary embodiment, a plurality of third grooves 12 are scored along the body 11 and travel along a combined width of the long side 16, the intermediate side 21 and the short side 19, respectively. Such third grooves 12 are registered substantially orthogonal to the longitudinal length of the body 11.

In a non-limiting exemplary embodiment, the body 11 includes a plurality of segments 11*a* contiguously aligned at an end-to-end pattern along the longitudinal length of the body 11. Each of the segments 11*a* has a uniform cross-section 15 and extends along the long side 16, the intermediate side 21 and the short side 19. In this manner, the third grooves 12 are located at conjoined ends of the segments 11*a* of the body 11. Notably, each of the long side 16, the intermediate side 21 and the short side 19 extends along the entire longitudinal length of the body 11.

The first groove 13, second groove 18 and third grooves 12 may be formed as lines of weakness along body 11.

The present disclosure also includes a method of utilizing a cabinet guard 10 for protecting an edge of a framework associated with a cabinet or shelf. The method includes the chronological steps of: providing a body 11 having a plurality of sides including a long side 16 and an intermediate side 21 attached thereto wherein the intermediate side 21 extends at a generally ninety degree angle from the long side 16 and wherein each of the long side 16 and the intermediate side 21 is planar; and fitting the sides 16, 21 over the edge of the framework.

Figure 2:
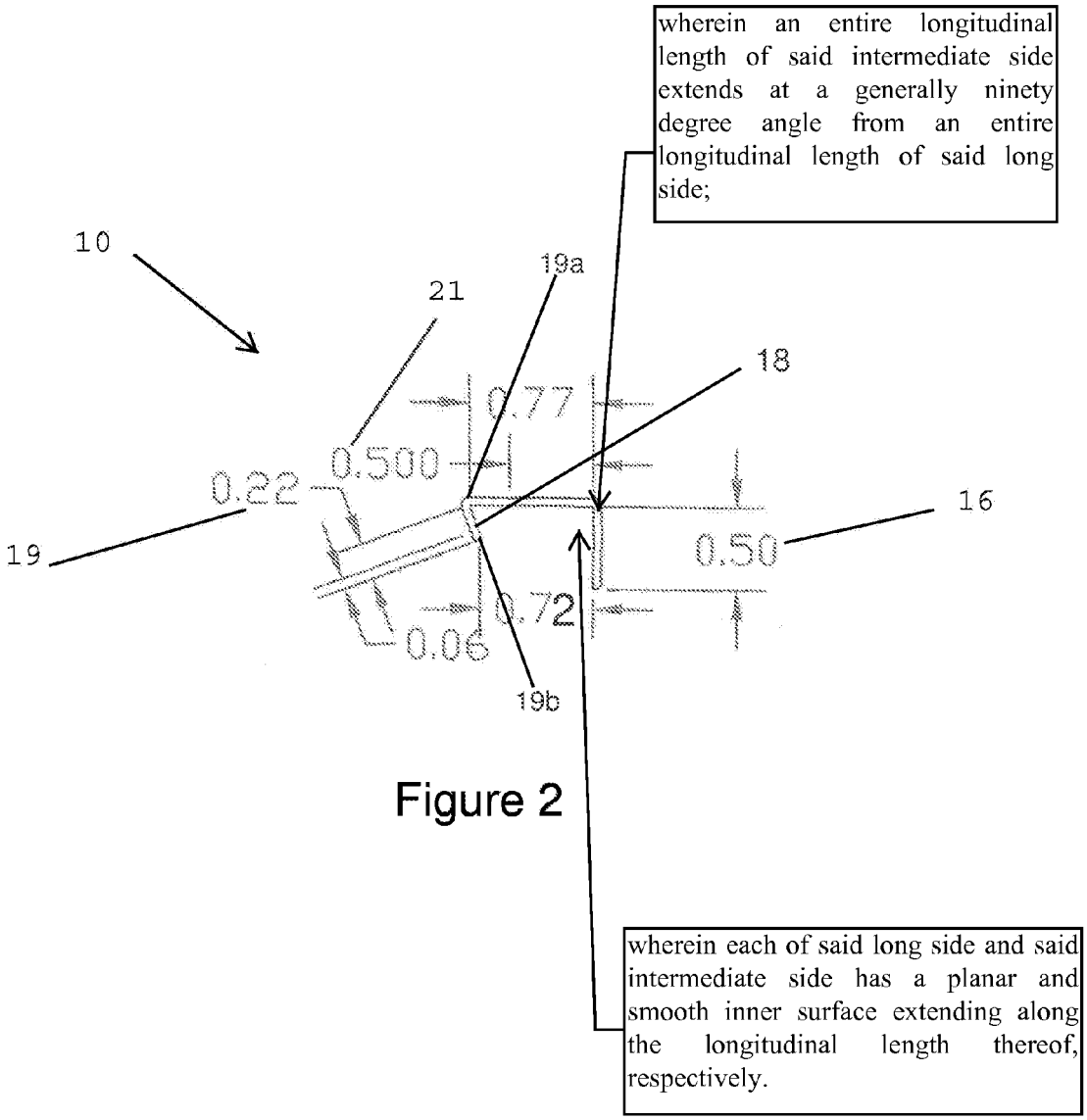
FIG. 2 is a front elevational view of the cabinet guard shown in FIG. 1.
Figure 4:
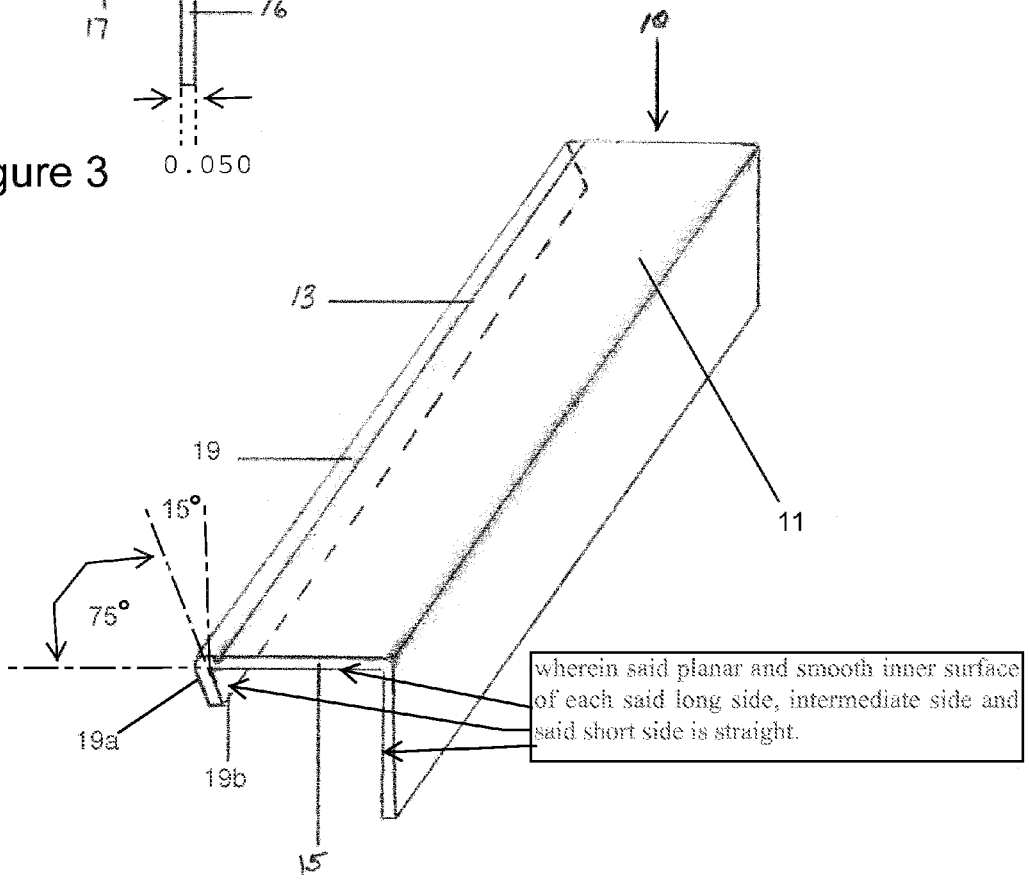
FIG. 4 is a perspective view of a cabinet guard for protecting an edge of cabinet/shelf framework, in accordance with yet another non-limiting exemplary embodiment.

Referring to FIGS. 1-2 and 4, in non-limiting exemplary embodiments, the cabinet guard 10 includes a body 11 preferably formed from a plastic material. Of course, the body 11 may be formed from cellulose acetate butyrate or any material that is suitable for retaining its shape after being cut to size via scissors or other conventional cutting implements. For example, cabinet guard 10 may be formed from clear plastic so a user can see the cabinet/shelf color and finish.

Figure 3:
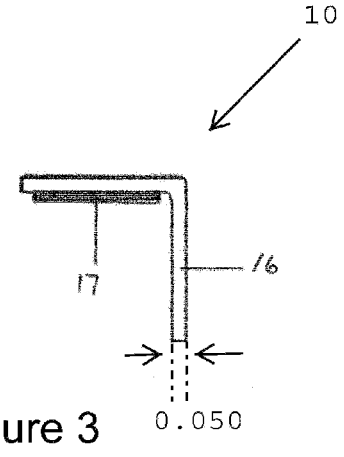
FIG. 3 is a front elevational view of a cabinet guard for protecting an edge of cabinet/shelf, in accordance with another non-limiting exemplary embodiment.

The body 11 is generally shaped to having an L-like (e.g. substantially L-shaped as shown in FIG. 3) or C-like (e.g., substantially C-shaped as shown in FIGS. 1-2 and 4-5) cross-section 15. Such a cross-section 15 is configured by a plurality of sides including a long side 16, an intermediate side 21 and a short side 19. Each side preferably has a thickness of approximately 0.050 inches. Each side may extend along an entire longitudinal length of body 11 or may be adjusted to terminate prior to reaching an end of the body 11. The body 11 may be snapped over edges of the cabinet/shelf framework, thereby protecting same from dents and dings while moving items (e.g., glasses, pots, pans, dishes, etc.) in and out of the cabinets/shelves.

In a non-limiting exemplary embodiment, long side 16 may be smooth and/or planar for fitting flush against one side of the cabinet/shelf framework edge. As noted above, the thickness of long side 16 may be approximately 0.050 inches so that the cabinet door is able to rest at an equilibrium position when closed. A height of long side 16 may be approximately 0.50 inches to adequately shield an outer surface area of the cabinet/shelf framework edge. Of course, such dimensions may be modified to fit various sized cabinet framework/shelf edges.

In a non-limiting exemplary embodiment, intermediate side 21 of body 11 may extend at a generally ninety degree angle from long side 16. Such an orthogonal relationship between long and intermediate sides 16, 21 ensures body 11 fits snug along the cabinet/shelf framework edge. A width of intermediate side 21 is preferably approximately 0.77 inches. A first groove 13 may be scored along a longitudinal length of intermediate side 21 and spaced approximately 0.50 inches from long side 16. Such a first groove 13 may travel in a linear direction defined substantially parallel to long side 16. In this manner, the width of intermediate side 21 may be adjusted by simply cutting or snapping intermediate side 21 along the first groove 13. As noted above, the thickness of intermediate side 21 may be approximately 0.050 inches.

In a non-limiting exemplary embodiment, short side 19 of body 11 preferably extends away from intermediate side 21 and is obliquely angled thereto. That is, short side 19 is oriented at a non-perpendicular angle relative to intermediate side 21. Short side 19 is also not parallel to long side 16. Thus, a proximal edge 19*a* of short side 19 may be spaced approximately 0.77 inches from long side 16, while a distal edge 19*b* of short side 19 may be spaced at a smaller distance from long side 16. In this manner, short side 19 provides frictional and/or tensional contact with a cabinet/shelf framework edge, thereby ensuring body 11 is snuggly fitted thereabout. A height of short side 19 may be approximately 0.22 inches. The oblique angle of short side 19, relative to intermediate side 21, may be approximately 15-25 degrees.

In a non-limiting exemplary embodiment, a second groove 18 may be scored along a longitudinal length of short side 19 and spaced at a desired location between its proximal and distal ends. For example, second groove 18 may be spaced approximately 0.06 inches away from the distal edge 19*b* of short side 19. Such a second groove 18 may travel in a linear direction defined substantially parallel to long side 16. In this manner, the height of short side 19 may be adjusted by simply cutting or snapping short side 19 along the second groove 18. As noted above, the thickness of short side 19 may be approximately 0.050 inches.

Now referring to FIG. 3, in a non-limiting exemplary embodiment, short side 19 may be entirely removed from body 11 such that body 11 defines a substantially L-like cross-section 15. A fastener such as a double-sided adhesive tape 17 is affixed to a bottom surface of intermediate side 21 for securing body 11 to edge of the cabinet/shelf framework. As best shown in FIG. 4, a portion of short side 19 may be removed by separating such a portion along second groove 18.

Figure 5:
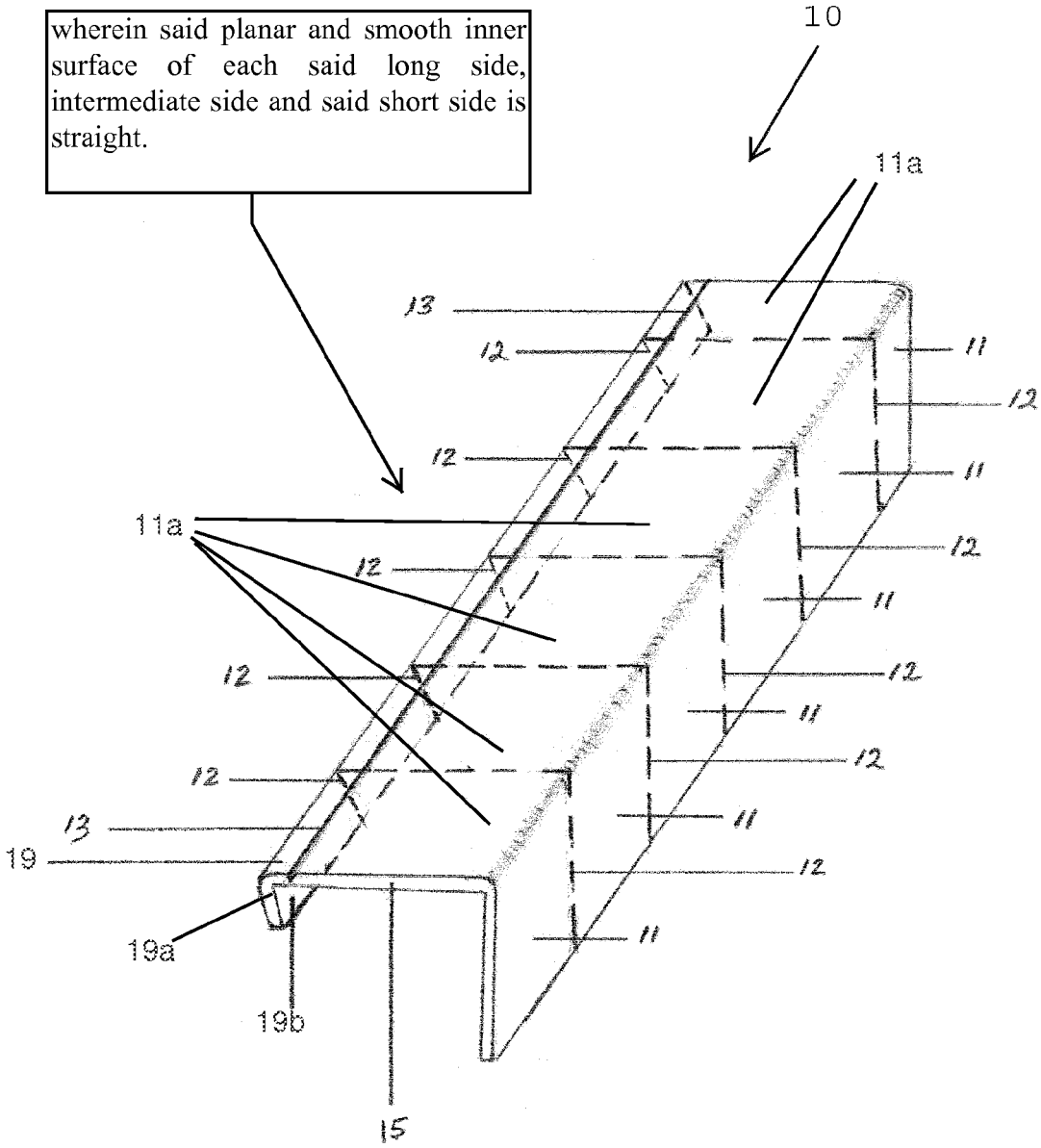
FIG. 5 is a perspective view of a cabinet guard for protecting an edge of cabinet/shelf framework, in accordance with yet another non-limiting exemplary embodiment.

Referring to FIG. 5, in a non-limiting exemplary embodiment, a plurality of third grooves 12 may be scored along body 11. Such third grooves 12 preferably travel along an entire combined width of long, intermediate and short sides 16, 21, 19, respectively. In this manner, third grooves 12 are registered substantially orthogonal to the longitudinal length of body 11. Thus, body 11 may be divided into a plurality of segments, each having a uniform cross-section 15. Such third grooves 12 enable a user to quickly cut/snap body 11 to size based on the longitudinal length of the cabinet/shelf framework edge.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A cabinet guard for protecting an edge of a framework associated with a cabinet or shelf, said cabinet guard comprising:

a body having a plurality of sides suitably sized and shaped to be capable of fitting over the edge of the framework, said plurality of sides comprising a long side and an intermediate side attached thereto; and wherein an entire longitudinal length of said intermediate side extends at a generally ninety degree angle from an entire longitudinal length of said long side;

wherein each of said long side and said intermediate side has a planar and smooth entire inner surface exposed along the longitudinal length thereof, respectively;

wherein said plurality of sides further includes a short side conjoined to said intermediate side and oppositely seated from said long side, respectively; wherein said body has a substantially C-shaped cross-section;

wherein said short side has a planar and smooth entire inner surface exposed along a longitudinal length thereof;

wherein said long side has a greater width than said short side;

a plurality of third grooves scored along said body and traveling along a combined width of each of said long side, said intermediate side and said short side, respectively;

wherein said third grooves are registered substantially orthogonal to the longitudinal length of said body.

2. The cabinet guard of claim 1, wherein said intermediate side comprises an outer surface including:

a first groove scored along the longitudinal length thereof, said first groove traveling in a linear direction defined substantially parallel to the longitudinal length of said long side;

wherein said first groove bifurcates a width of said intermediate side.

3. The cabinet guard of claim 2, wherein said short side extends away from said intermediate side and is obliquely angled thereto such that said short side converges towards said long side; wherein an oblique angle between said short side and said intermediate side is approximately 15 degrees.

4. The cabinet guard of claim 2, wherein said short side is oriented at a non-perpendicular angle relative to said intermediate side such that a height of said short side is not parallel to a height of said long side.

5. The cabinet guard of claim 4, wherein a proximal edge of said short side is an edge of said short side proximal to said intermediate side; wherein a distal edge of said short side is an edge of said short side distal to said intermediate side; wherein said proximal edge of said short side is spaced at a greater distance from a point on said long side immediately opposite to said proximal edge than a distance between said distal edge of said short side and a point on said long side immediately opposite to said distal edge.

6. The cabinet guard of claim 5, wherein said short side comprises an outer surface including:

a second groove scored along a longitudinal length thereof and spaced between said proximal edge and said distal edge;

wherein said second groove travels in a linear direction defined substantially parallel to the longitudinal length of said long side;

wherein said second groove bifurcates a height of said short side.

7. The cabinet guard of claim 6, wherein said body comprises:

a plurality of segments contiguously aligned at an end-to-end pattern along the longitudinal length of said body;

wherein each of said segments has a uniform cross-section and extends along said long side, said intermediate side and said short side;

wherein said third grooves are located at conjoined ends of said segments of said body;

wherein each of said long side, said intermediate side and said short side extends along the entire longitudinal length of said body.

8. A cabinet guard for protecting an edge of a framework associated with a cabinet or shelf, said cabinet guard comprising:

a body having a plurality of sides suitably sized and shaped to be capable of fitting over the edge of the framework, said plurality of sides comprising a long side and an intermediate side attached thereto; and wherein an entire longitudinal length of said intermediate side extends at a generally ninety degree angle from an entire longitudinal length of said long side;

wherein each of said long side and said intermediate side has a planar and smooth entire inner surface exposed along the longitudinal length thereof, respectively;

wherein said plurality of sides further includes a short side conjoined to said intermediate side and oppositely seated from said long side, respectively; wherein said body has a substantially C-shaped cross-section;

wherein said short side has a planar and smooth entire inner surface exposed along a longitudinal length thereof;

wherein said planar and smooth inner surface of each said long side, intermediate side and said short side is straight;

wherein said long side has a greater width than said short side;

a plurality of third grooves scored along said body and traveling along a combined width of each of said long side, said intermediate side and said short side, respectively;

wherein said third grooves are registered substantially orthogonal to the longitudinal length of said body.

9. The cabinet guard of claim 8, wherein said intermediate side comprises an outer surface including:

a first groove scored along the longitudinal length thereof, said first groove traveling in a linear direction defined substantially parallel to the longitudinal length of said long side;

wherein said first groove bifurcates a width of said intermediate side.

10. The cabinet guard of claim 9, wherein said short side extends away from said intermediate side and is obliquely angled thereto such that said short side converges towards said long side; wherein an oblique angle between said short side and said intermediate side is approximately 15 degrees.

11. The cabinet guard of claim 9, wherein said short side is oriented at a non-perpendicular angle relative to said intermediate side such that a height of said short side is not parallel to a height of said long side.

12. The cabinet guard of claim 11, wherein a proximal edge of said short side is an edge of said short side proximal to said intermediate side; wherein a distal edge of said short side is an edge of said short side distal to said intermediate side; wherein said proximal edge of said short side is spaced at a greater distance from a point on said long side immediately opposite to said proximal edge than a distance between said distal edge of said short side and a point on said long side immediately opposite to said distal edge.

13. The cabinet guard of claim 12, wherein said short side comprises an outer surface including:

a second groove scored along a longitudinal length thereof and spaced between said proximal edge and said distal edge;

wherein said second groove travels in a linear direction defined substantially parallel to the longitudinal length of said long side;

wherein said second groove bifurcates a height of said short side.

14. The cabinet guard of claim 13, wherein said body comprises:

a plurality of segments contiguously aligned at an end-to-end pattern along the longitudinal length of said body;

wherein each of said segments has a uniform cross-section and extends along said long side, said intermediate side and said short side;

wherein said third grooves are located at conjoined ends of said segments of said body;

wherein each of said long side, said intermediate side and said short side extends along the entire longitudinal length of said body.

15. A method of utilizing a cabinet guard for protecting an edge of a framework associated with a cabinet or shelf, said method comprising the steps of:

providing a body having a plurality of sides comprising a long side and an intermediate side attached thereto; wherein said intermediate side extends at a generally ninety degree angle from said long side;

wherein an entire longitudinal length of said intermediate side extends at a generally ninety degree angle from an entire longitudinal length of said long side;

wherein each of said long side and said intermediate side has a planar and smooth entire inner surface exposed along the entire longitudinal length thereof, respectively;

wherein said plurality of sides further includes a short side conjoined to said intermediate side and oppositely seated from said long side, respectively; wherein said body has a substantially C-shaped cross-section;

wherein said short side has a planar and smooth entire inner surface exposed along an entire longitudinal length thereof;

wherein said planar and smooth inner surface of each said long side, intermediate side and said short side is straight; and fitting said long side, said intermediate side and said short side over the edge of the framework;

wherein said long side has a greater width than said short side;

a plurality of third grooves scored along said body and traveling along a combined width of each of said long side, said intermediate side and said short side, respectively;

wherein said third grooves are registered substantially orthogonal to the longitudinal length of said body.

* * * * *